US007763816B2

(12) United States Patent
Buschmann

(10) Patent No.: US 7,763,816 B2
(45) Date of Patent: Jul. 27, 2010

(54) ACTUATING DEVICE

(75) Inventor: Gerd Buschmann, Velbert (DE)

(73) Assignee: Huf Hulsbeck & Furst GmbH & Co. (DE)

( * ) Notice: Subject to any disclaimer, the term of this patent is extended or adjusted under 35 U.S.C. 154(b) by 0 days.

(21) Appl. No.: 11/910,710

(22) PCT Filed: Mar. 16, 2006

(86) PCT No.: PCT/EP2006/060809

§ 371 (c)(1),
(2), (4) Date: Dec. 6, 2007

(87) PCT Pub. No.: WO2006/106033

PCT Pub. Date: Oct. 12, 2006

(65) Prior Publication Data

US 2008/0156626 A1 Jul. 3, 2008

(30) Foreign Application Priority Data

Apr. 5, 2005 (DE) ..... 10 2005 015 643

(51) Int. Cl.
*H01H 19/06* (2006.01)

(52) U.S. Cl. ..... 200/302.3; 200/302.1

(58) Field of Classification Search ..... 200/61.62
See application file for complete search history.

(56) References Cited

U.S. PATENT DOCUMENTS 3,742,162 A * 6/1973 Wasemann ..... 200/61.62
5,482,142 A * 1/1996 Kulak ..... 187/280
5,788,059 A * 8/1998 Jahangiri ..... 200/302.3
6,930,263 B2 * 8/2005 Hung ..... 200/61.62
7,268,306 B2 * 9/2007 Ikunami ..... 200/11 R

FOREIGN PATENT DOCUMENTS

| | | |
|---|---|---|
| DE | 33 11 992 | 10/1984 |
| DE | 692 22 934 | 11/1992 |
| DE | 199 53 046 | 5/2000 |
| DE | 100 20 172 | 11/2001 |
| DE | 102 49 579 | 5/2004 |
| EP | 0 579 867 | 1/1994 |
| EP | 1 096 243 | 5/2001 |
| EP | 1 329 573 | 9/2002 |
| EP | 1 284 335 | 2/2003 |
| FR | 2 860 538 | 4/2005 |

OTHER PUBLICATIONS

International Search Report; PCT/EP2006/060809; Aug. 17, 2006.

* cited by examiner

*Primary Examiner*—Michael A Friedhofer
*Assistant Examiner*—Lheiren Mae A Caroc
(74) *Attorney, Agent, or Firm*—Cantor Colburn LLP

(57) ABSTRACT

The invention relates to an actuating device for closing and/or opening a movable part (2) of a motor vehicle, in particular a door, a rear flap or the like, with a housing (3), and a rotatably mounted touch element (4) which, upon actuation, acts on a switch (6) arranged behind the touch element (4) in a shielded interior space (5). According to the invention, it is provided that the touch element (4) is mounted pivotably in such a manner that the volume of the interior space (5) is essentially the same in every position of the touch element (4).

15 Claims, 1 Drawing Sheet

FIG.1
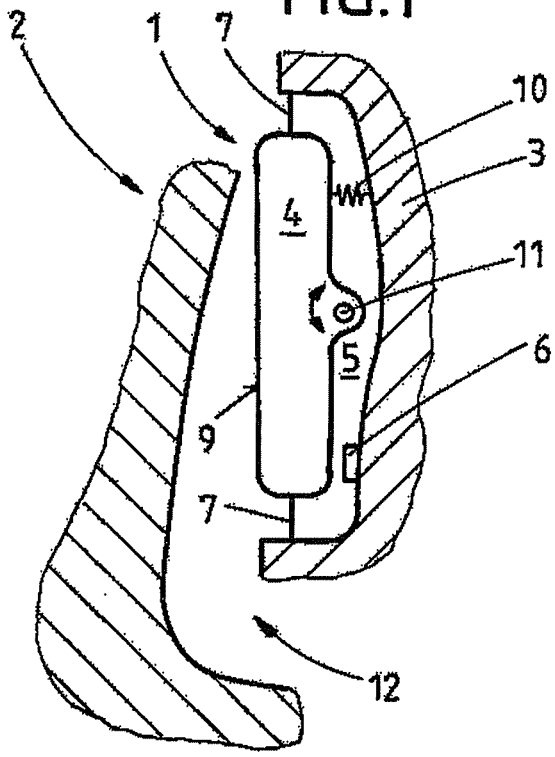
FIG.2
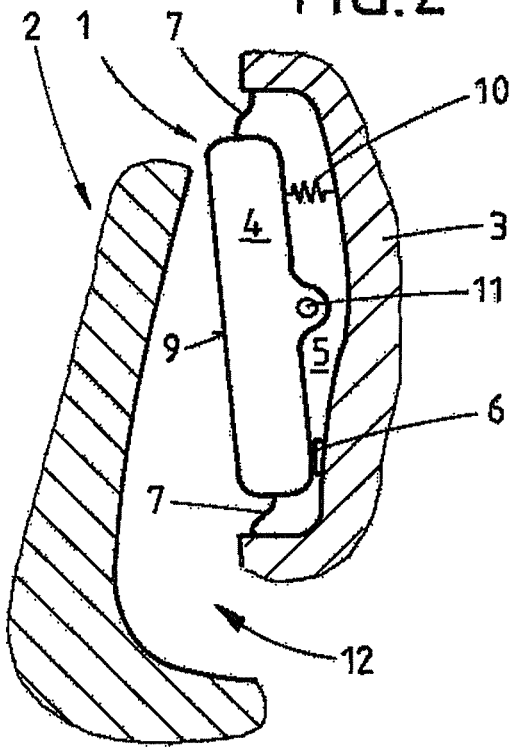
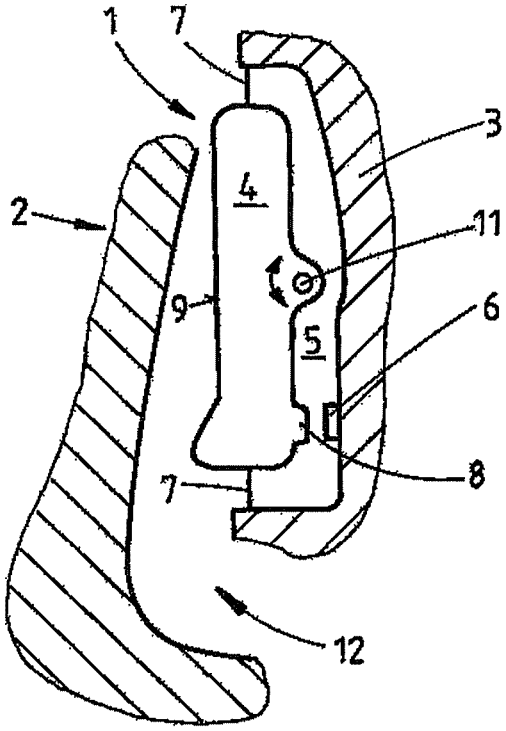
FIG.3
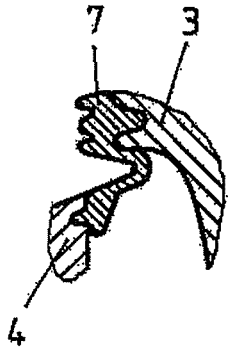
FIG.4

ACTUATING DEVICE

TECHNICAL FIELD OF THE INVENTION

The invention relates to an actuating device for closing and/or opening a moving part of a motor vehicle, in particular a door, a tailgate or the like, with a casing, a rotating pushbutton element, which when actuated acts on a switch located behind the pushbutton element in a shielded interior space. In the present invention, the switch is understood as a switching element or activation element, in particular a grid, pushbutton, sensor or the like.

BRIEF DESCRIPTION OF RELATED ART

Such actuating devices are known from prior art. The actuating devices are required in particular for automobile construction for opening car doors or tailgates by actuating a grip or handle, wherein a door lock is opened or closed electromechanically or in some other way.

These actuating devices are preferably protectively incorporated in a grip cavity, wherein the actuating device exhibits a pushbutton element rotatably mounted at least on one side, which when actuated acts on a switch situated behind the pushbutton element in a shielded (closed) interior space. To ensure that the actuating device functions satisfactorily, the expert takes the known step of introducing vent holes in the actuating device. When the pushbutton element is actuated, it is simultaneously pivoted around an asymmetrically arranged swiveling axis, thereby compressing the air in the interior space and allowing it to escape through the present vent holes. The vent holes are generally located in the casing, and join the vehicle interior with the interior space of the actuating device, so that the volume displaced by the pushbutton element can escape. One of the important disadvantages to such an actuating device is that moisture can penetrate into the actuating device through the vent holes, which can significantly impair the function of the actuating device, in particular of the switch. For this reason, the used switch and its electrical contact points must be protected against exposure to weather. This requires additional manufacturing steps, giving rise to extra costs.

Also known is to arrange filter elements in the aforementioned holes to prevent moisture from penetrating into the interior space of the actuating device. For example, DE 692 22 934 T2 discloses a filter consisting of PTFE (polytetrafluroethylene) in a pressure switch. The disadvantage is that the vent holes and protective filter significantly increase the cost of manufacturing the actuating device.

BRIEF SUMMARY OF THE INVENTION

The invention develops an actuating device for a motor vehicle that avoids the specified disadvantages, in particular an actuating device that is simple in design, can be assembled without any significant outlay, and exhibits good functional properties.

To this end, the invention provides that the pushbutton element be pivoted in such a way that the volume in the interior space is essentially equal in any position of the pushbutton element. The mount can be a rotating or pivoting mount, for example. The special advantage of this invention is that air need not be expelled from the interior space of the actuating device in any position of the pushbutton element. For this reason, expensive vent holes with the disadvantages cited in prior art need not be introduced. Advantageously, the interior space of the actuating device is essentially shielded form the environment and vehicle interior, so that dirt or moisture, for example, cannot penetrate into the interior space. This means that the air is sealed in the interior space, and cannot escape into the environment or inside the vehicle. As a result, the switch secured in the interior space is protected, thereby significantly increasing the life of the actuating device and its functional properties. The wall of the casing and wall of the pushbutton element essentially confine the volume of the interior space.

In one possible embodiment of the invention, the pushbutton element can be mounted in an essentially symmetrical manner. For example, the pushbutton element can be designed as a two-armed lever element, wherein the swiveling axis is arranged centrally on the pushbutton element. When the pushbutton element is actuated, an arm of the lever element moves into the interior space, while the second arm of the lever element simultaneously pivots out of the interior space. In this embodiment, the pushbutton element represents a kind of flap that can be pivoted around the centrally located swiveling axis. Another advantage to this actuating device is that varying influences of air pressure in the environment, e.g., owing to downhill runs at a certain elevation, cannot automatically or unintentionally trigger the actuating device. What kind of outside pressure acts on the pushbutton element is irrelevant with respect to the actuating device according to the invention. The symmetrical accommodation always offsets the forces or torques acting on the pushbutton element from the interior space as well as the environment. Given the symmetrical accommodation, the pushbutton element can be arranged on the swiveling axis in an axially symmetrical manner, for example. The swiveling axis can here run horizontally, vertically or even diagonally in a possible embodiment of the invention. According to the invention, the axially symmetrical positioning prevents a displacement volume from arising, which would have to be removed from the interior space for the actuating device to function reliably. This invention also makes it possible to avoid spurious tripping brought on by temperature fluctuations. As opposed to devices known from prior art, low temperatures no longer produce a reduction in the internal volume, thereby effectively preventing the pushbutton element from moving toward the switch, as well as any unintended tripping of the actuating device.

In another alternative of the invention, the pushbutton element is non-positively and/or positively and/or materially bonded with the casing of the actuating device by means of a sealant. In an especially preferred embodiment, the sealant is bonded with the casing with a continuous laser weld. Of course, the sealant can alternatively be secured to the casing via a friction weld, ultrasound weld or adhesive bond.

The sealant is best an elastic membrane comprised of a plastic, wherein the membrane keeps the pivoting pushbutton element at a slight distance from the switch while at rest, enabling an extremely flat design for the actuating device. In another possible embodiment for the actuating device, the pushbutton element and elastic membrane can be designed as a single plastic part. The pushbutton element can be made out of a plastic material, and can be designed as a lightweight component with reinforcing webs.

The pushbutton element preferably is spaced away from the switch in a first position, and contacts it in a second position. In a first position (rest), the distance between the pushbutton element and switch preferably ranges between 0.5 mm and 5 mm, preferably between 0.7 mm and 3 mm, and especially preferably between 1 mm and 2 mm. When actuated, the pushbutton element lifts slightly, and comes into contact with the switch in the second position, which activates an electric motor of an electric door/tailgate lock via an electronic controller in one possible embodiment, thereby moving the actuating device to an open position. For example, the switch can project from the wall of the casing into the interior space. It is also conceivable for the switch to be situated in a recess of the casing.

In another advantageous embodiment of the invention, the pushbutton element exhibits a projection extending into the interior space, which contacts the switch in the second position. At rest, the projection is spaced apart form the switch at the distance specified above.

The actuating device is preferably designed in such a way as to enable a swiveling from the first into the second position and vice versa, depending on function, given activation at different positions of the pushbutton element. In a preferred embodiment, the actuating device is protected in a grip cavity, wherein the user must place his hand into the grip cavity to activate the pushbutton element, in order to subsequently exert a specific force on the pushbutton element with his fingers. The pushbutton element is best ergonomic in design, wherein the pushbutton element exhibits a keytop touch area facing away from the interior space. This ensures a reliable activation of the independently of where the keytop touch area of the pushbutton element is exposed to pressure.

In a preferred embodiment, the actuating device exhibits a resetting mechanism, which moves the pivoting pushbutton element from the second into the first position. When the pushbutton element is actuated, the resetting mechanism triggers a corresponding restoring moment. In one possible embodiment, the resetting mechanism can exhibit a spring element that interacts with the pushbutton element.

Of course, the resetting mechanism can be integrated into the switch in another embodiment of the invention. In this embodiment, the switch itself generates a corresponding restoring moment, which pivots the pushbutton element from the second position into the neutral position. The switch can here be designed as a sensitive switch. In another possible alternative, the switch, which is to be understood as a general activation element for opening a moving part (door, tailgate or the like) in terms of this invention, can be designed as an electromagnetic switch or sensor, in particular as a capacitive sensor or Hall sensor, or as a piezoelectric element.

It is also conceivable for the sealant that bonds the pushbutton element with the casing to exert a corresponding reset force or restoring moment as an alternative or in addition to the means mentioned above.

In another possible embodiment of the actuating device, the pushbutton element exhibits an angle of rotation from the first position to the second position ranging between 2° and 10°, preferably between 3° and 8°, and in a particularly preferred embodiment between 4° and 6°. This provides for a compact, flat actuating device that requires a low overall height. A force measuring between 5 N and 30 N, preferably between 7 N and 20 N, and especially preferred between 10 N and 15 N is necessary to move the pushbutton element from the first position into the second position. The restoring moment of the resetting mechanism must be adjusted accordingly to the force necessary for the adjustment.

BRIEF DESCRIPTION OF THE DRAWINGS

Other advantages, features and particulars of the invention can be gleaned from the following specification, which describes several exemplary embodiments of the invention in detail, making reference to the drawings. The features mentioned in the claims and specification can here be essential with respect to the invention either taken individually or in any combination. Shown on:

FIG. 1 is a sectional view of the actuating device in the neutral position;

FIG. 2 is the actuating device according to FIG. 1, wherein the switch is contacted;

FIG. 3 is an alternative embodiment of the actuating device, and on

FIG. 4 is a possible embodiment of the sealing element of the actuating device.

DETAILED DESCRIPTION OF THE INVENTION

FIG. 1 shows an actuating device 1 for electromagnetically actuating a tailgate 2 of a motor vehicle. As illustrated on FIG. 1, the actuating device 1 is protectively incorporated in a grip cavity 12. The actuating device 1 comprises a pushbutton element 4, which is mounted on the tailgate 2 so that it can rotate on a casing 3. Situated behind the pushbutton element 4 is a shielded interior space 5, which contains a switch 6. The switch 6 can be designed as a microswitch, for example. The interior space 5 is completely separated from the exterior area of the motor vehicle by means of a sealant 7. There is also no connection to the interior space 5 from the vehicle interior. In the exemplary embodiment shown, the sealant 7 is an elastic membrane 7 that joins the pushbutton element 4 with the casing 3 of the actuating device 1. The membrane 7 is here only shown diagrammatically. In this exemplary embodiment, the elastic membrane 7 is laser welded with the casing 3. FIG. 4 illustrates a possible arrangement of the membrane 7 on the casing 3 and on the pushbutton element 4.

The pushbutton element 4 exhibits a horizontally swiveling axis 11, wherein the pushbutton element 4 is positioned asymmetrically to the swiveling axis 11. The pushbutton element 4 is an injection-molded part made of plastic in the exemplary embodiment, and located in a first position (neutral position), in which it is spaced apart from the switch 6. The distance here measures approx. 1.5 mm.

Actuating the switch 6 requires that a switch actuating force act on the pushbutton element 4, pivoting the pushbutton element 4 by a specific angle. FIG. 2 illustrates the contacting of the switch 6. The force required on the keytop touch area 9 of the pushbutton element 4 measures 15 N, so that the pushbutton element 4 designed as a kind of two-armed lever element on FIG. 1 and FIG. 2 comes into contact with the side facing the interior space 5. Contacting the switch 6 initiates a process of opening the tailgate 2, which is not described in detail. The pushbutton element 4 is swiveled from the first position into the second position around the swiveling axis at an angle of rotation of approx. 5°.

In order to pivot the pushbutton element 4 from the second position back into the first position, the actuating device 1 exhibits a resetting mechanism 10, which exerts a correspondingly high restoring torque on the pushbutton element 4. The resetting mechanism 10 can encompass a spring element 10, for example, which is shown on FIG. 1 and FIG. 2. The spring element 10 is secured on a first side to the casing 3, and on a second side opposite the first side to the pushbutton element 4. If the switch actuation force moves the pushbutton element 4 counterclockwise on the swiveling axis 11 from a first position into the second position, the spring element 10 spaced apart from the swiveling axis 11 exerts a corresponding restoring torque on the pushbutton element 4.

The resetting mechanism 10 is integrated into the switch 6 on FIG. 3. If the pushbutton element 4 contacts the switch 6, it exerts a corresponding reset force on the surface of the pushbutton element 4 facing the interior space 5. In addition or as an alternative, the elastic membrane 7 can exert a restoring torque on the pushbutton element 4. The pushbutton element 4 on FIG. 3 also has a projection 8, which extends into the interior space 5 of the actuating device 1. When the pushbutton element 4 is in the neutral position, the projection 8 is spaced correspondingly apart from the switch 6, wherein the projection 8 contacts the switch 6 in the second position of the pushbutton element 4. In the embodiment shown, the projection 8 is connected with the pushbutton element 4 as a single piece. Of course, the projection 8 can also be secured as a separate component to the side of the pushbutton element 4 facing the interior space 5, which is not explicitly shown. The pushbutton element 4 additionally has an ergonomic design on the side facing away from the interior space 5 in the area of the grip cavity 12, making it easier for the user to actuate the pushbutton element 4.

As illustrated purely diagrammatically on FIG. 1 and FIG. 2, the volume of the interior space 5 is essentially identical in every position of the pushbutton element 4, thereby improving the functionality of the actuating device 1. The volume of the interior space 5 is confined in the exemplary embodiments by the wall of the casing 3, the wall of the pushbutton element 4 and the sealant 7, which tightly connects the edge area of the pushbutton element 4 with the casing 3. In an alternative embodiment, the switch 6 can also act as a sensor, with which the tailgate can be closed and opened, or the lock of the tailgate 2 can be unlocked and locked. For example, the sensor can be a capacitive sensor or a Hall sensor. In another possible alternative, the mentioned switch 6 can also be designed as an electromagnetic switch or piezoelectric element.

The depicted pushbutton element 4 from FIG. 1 to 3 is positioned inside the grip cavity 12 in such a way that the user can actuate the lower lever arm of the pushbutton element 4 facing the switch 6. This ensures a reliable actuation of the pushbutton element 4 independently of where the keytop touch area 9 is exposed to pressure, e.g., which can be profiled on its surface.

FIG. 1 to 3 illustrate the layout of the membrane 6 in a strictly diagrammatic manner. One possible connection between the pushbutton element 4 and the casing 3 via the membrane 7 is depicted on FIG. 4 as an example. The pushbutton element 4 can be welded or boned to the membrane 7, for example. In an alternative of the invention not shown, the membrane 7 can also be connected with the pivoting pushbutton element 4 as a single piece.

The invention claimed is:

1. An actuating device for closing and opening a moving part of a motor vehicle comprising: a casing, a rotatably mounted pushbutton element which, when actuated, acts on a switch arranged behind the pushbutton element in a shielded interior space, wherein the pushbutton element can swivel around a swiveling axis in such a way that a volume of fluid medium contained in the interior space remains essentially the same in any position of the pushbutton element, wherein the fluid medium is substantially sealed within the interior space of the actuating device via a sealant material, wherein the interior space is confined by the casing, the pushbutton element, and the sealant material, the sealant material tightly connecting an edge area of the pushbutton element with the casing, the pushbutton element is symmetrically mounted; and the pushbutton element is designed as a two-armed lever element, wherein the swiveling axis is centrally situated on the pushbutton element.

2. The actuating device according to claim 1, wherein the sealant material is an elastic membrane.

3. The actuating device according to claim 1, wherein the pushbutton element is spaced apart from the switch in a first position, and the pushbutton element contacts the switch in a second position.

4. The actuating device according to claim 3, wherein a distance between the switch and the pushbutton element measures between 0.5 mm and 5 mm.

5. The actuating device according to claim 3, wherein the pushbutton element exhibits a projection that extends into the interior space and contacts the switch in the second position.

6. The actuating device according to claim 3, wherein a resetting mechanism moves the pushbutton element from the second into the first position.

7. The actuating device according to claim 6, wherein the resetting mechanism exhibits a spring element that interacts with the pushbutton element.

8. The actuating device according claim 6, wherein the resetting mechanism is integrated into the switch.

9. The actuating device according claim 3, wherein the pushbutton element exhibits an angle of rotation from the first position to the second position lying between 2° and 10°.

10. The actuating device according to claim 3, wherein a force measuring between 5 N and 30 N is necessary to move the pushbutton element from the first position into the second position.

11. The actuating device according to claim 1, wherein the pushbutton element has an ergonomic design.

12. The actuating device according to claim 1, wherein the pushbutton element exhibits a keytop touch area facing away from the interior space.

13. A motor vehicle comprising an actuating device according to claim 1.

14. The actuating device according to claim 1, wherein the fluid medium is air.

15. The actuating device according to claim 1, wherein the pushbutton element is actuatable by an actuating device without contact between the actuating device and the sealant material.

* * * * *